United States Patent [19]

Kogler

[11] Patent Number: 5,072,459

[45] Date of Patent: Dec. 17, 1991

[54] PRECURLED MITTEN

[75] Inventor: Stephen D. Kogler, Baltimore, Md.

[73] Assignees: Stephen D. Kogler; Christopher A. Kogler, both of Brooklyn, N.Y.

[21] Appl. No.: 450,276

[22] Filed: Dec. 8, 1989

[51] Int. Cl.[5] ..... A41D 19/00

[52] U.S. Cl. ..... 2/158; 2/161 A; 2/17

[58] Field of Search ..... 2/158, 159, 160, 161 R, 2/161 A, 163, 169, 167, 168, 18, 16, 17

[56] References Cited

U.S. PATENT DOCUMENTS

| | | | |
|---|---|---|---|
| 1,302,766 | 5/1919 | Chambers | 2/17 |
| 1,387,728 | 8/1921 | Kramer | 2/168 |
| 1,450,155 | 3/1923 | Watson | 2/164 |
| 2,373,940 | 4/1945 | Beall | 2/168 |
| 3,096,523 | 7/1963 | Bruchas | 2/159 |
| 4,287,610 | 9/1981 | Rhee | 2/18 |

FOREIGN PATENT DOCUMENTS

| | | | |
|---|---|---|---|
| 54949 | 6/1982 | European Pat. Off. | 2/16 |
| 56007 | 7/1982 | European Pat. Off. | 2/16 |
| 170496 | 2/1952 | Fed. Rep. of Germany | 2/158 |
| 3339648 | 5/1985 | Fed. Rep. of Germany | 2/18 |
| 2626559 | 8/1989 | France | 2/16 |
| 1549525 | 8/1979 | United Kingdom | 2/17 |

OTHER PUBLICATIONS

Thunderwear Catalogue, Fall 1989, San Clemente, CA; 4 sheets Viking Stavanger Brochure, undated, Stavanger, Norway, 3 sheets.

Thunderwear Fall 1989 Dealer Program and Price List, pp. 5 and 6, Glove Models T-655 and T-657.

*Primary Examiner*—Werner H. Schroeder
*Assistant Examiner*—Sara M. Current
*Attorney, Agent, or Firm*—Darby & Darby

[57] ABSTRACT

Precurled mitten to a grip a rod such as a wind surfing sail boom, including a wrist enclosing section and a hand enclosing section integral therewith to form a waterproof mitten cavity, the wrist section having a tightening strap to hold the mitten against the wrist, and the hand section terminating in a permanently curved hook portion and an opposed permanently curved thumb portion following the natural, relaxed contour of the user's curled hand to receive the first four fingers and thumb, respectively. The hook and thumb portions define a lateral curl-like bore spaced therebetween to receive and snugly embrace the rod independently of finger force and to facilitate its positive gripping under unrestrained and thereby reduced finger force through the mitten, and the wrist and hand sections are formed of waterproof, thermally insulating, shape retaining, pliable sheeting material to transmit, substantially undiminished, hand exerted gripping force therethrough to the rod when in the bore space.

17 Claims, 1 Drawing Sheet

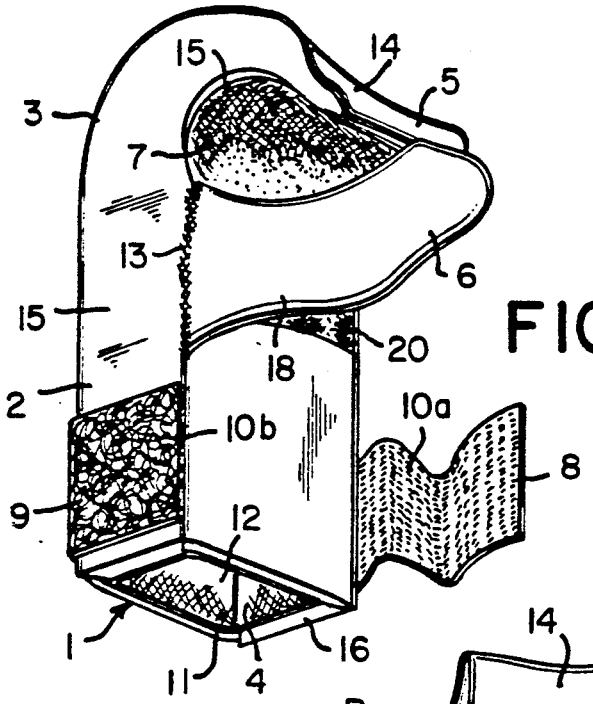
FIG. 1
FIG. 3
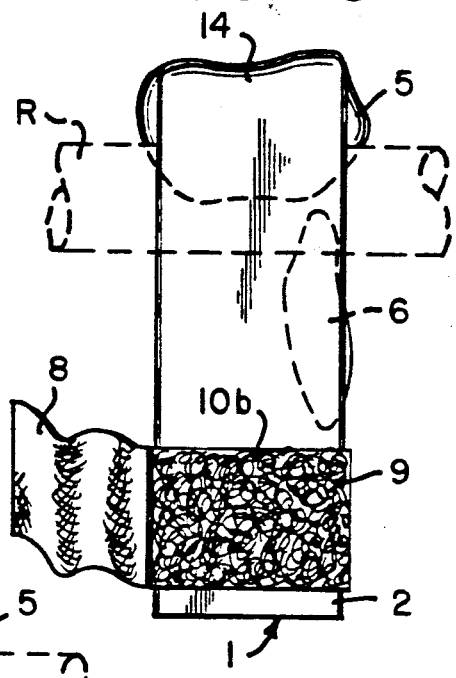
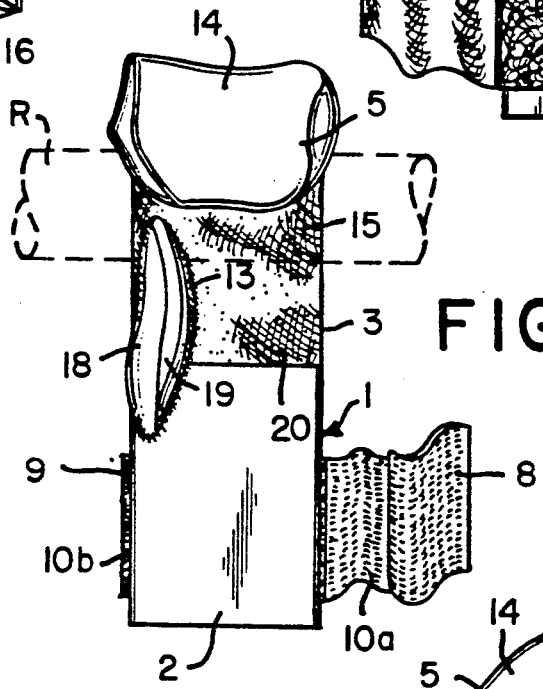
FIG. 2
FIG. 4
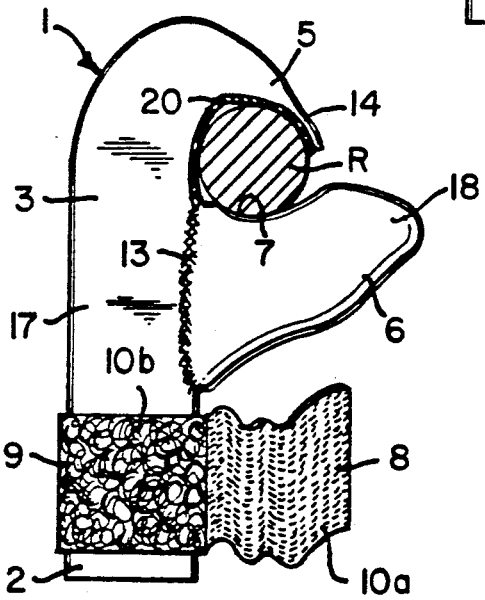
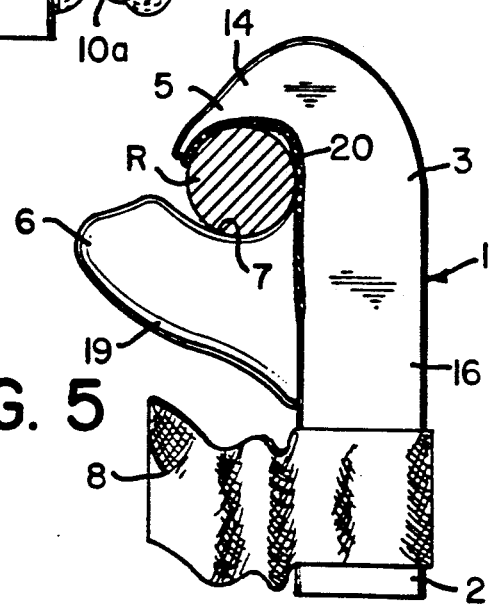
FIG. 5

PRECURLED MITTEN

FIELD AND BACKGROUND OF THE INVENTION

The present invention relates to a precurled mitten, and more particularly to such a mitten to grip a rod, e.g. a wind surfing sail boom, having a permanently curved hook portion and opposed thumb portion following the natural, relaxed contour of the user's curled hand to receive the first four fingers and thumb, respectively, and defining a lateral bore space therebetween to receive and snugly embrace the rod independently of finger force and to facilitate its gripping under unrestrained and thereby reduced finger force, the mitten being formed of waterproof, thermally insulating, shape retaining, pliable sheeting to transmit, substantially undiminished, hand exerted gripping force therethrough to the rod in the bore space.

Many sporting and recreational glove constructions are known, but each is designed for a very specific purpose.

Thus, U.S. Pat. No. 4,677,698 to Angas shows a flexible five fingered hockey glove, with the five individual finger cavities protected by padding on their back sides interrupted by cross grooves at the finger joints for full finger cavity flexing.

U.S. Pat. No. 3,918,096 to Lim shows a flexible five fingered motorcycle glove, with a curved attachment on its back side extending to the tips of the individual cavities for the first four fingers, to curve the hand to avoid stiffening and cramps on gripping the handle bars, the thumb cavity being unmodified and the construction allowing finger cavity flexing.

U.S. Pat. No. 4,745,870 to Roth shows a wind surfing harness extending across the back of the shoulders and arms, and having hand holdable rigid hooks or flexible five fingered gloves on its ends. The hooks are curved to grip a sail boom of a wind surfing board, and the gloves have hook catch and pile engaging means, such as sold under the trademark VELCRO, on the thumb pad and first two finger nail sides of the finger cavities to connect the thumb cavity to those of the first two fingers to surround and grip the boom by the gloved hands, to control the boom via the hooks or gloves as the user stands on the board.

In Roth, the hands can quickly release the hooks from the boom for safe escape of the user from the board, as the hands do not tire in use since the hooks grip the boom and detach from it easily. However, the gloves do not quickly release from the boom due to the hook catch and pile immobile connection of the thumb and first two finger cavities surrounding and gripping the boom. This subjects the user to a danger intensified after the hands tire on being cramped by the gloves around the boom in use, as they manually grip the boom and on tiring cannot rapidly separate that connection. The individual finger cavities of the gloves also present a large thermal loss area soon causing the fingers to become cold in cold weather.

SUMMARY OF THE INVENTION

It is an object of the invention to provide a waterproof precurled mitten, usable in cold water and/or weather at minimized thermal loss therethrough, to grip a hand holdable force transmission rod such as a sail boom on a wind surfing sail board, the mitten generally being permanently preshaped to follow the natural, relaxed contour of the curled hand of the user to receive and normally snugly embrace that rod independently of finger applied gripping force and in turn to facilitate positive gripping of the rod at unrestrained and thereby reduced finger applied gripping force to transmit substantially undiminished, that force through the mitten to the rod.

It is another object of the invention to provide such a mitten which can be made from conventional materials in simple and inexpensive manner, and which is robust and durable in use.

According to the invention, a precurled mitten for gripping a hand holdable force transmission rod such as a sail boom as used in wind surfing, is advantageously provided, comprising a rear wrist enclosing section and a front hand enclosing section integral therewith to form a substantially waterproof mitten cavity, the hand section terminating in a generally permanently curved hook portion following the natural, relaxed contour of the curled hand of the user to receive the first four fingers, and an opposed generally permanently curved thumb portion following the natural, relaxed contour of the corresponding thumb to receive the thumb.

The hook and thumb portions define therebetween a laterally extending concave curl-like bore space sized and shaped to receive and normally snugly embrace the force transmission rod generally independently of finger applied gripping force and to facilitate positive gripping of the rod through the mitten under generally unrestrained and thereby reduced finger force.

The wrist and hand enclosing sections are formed of waterproof, thermally insulating, shape retaining, pliable sheeting material capable of transmitting, substantially undiminished, hand exerted gripping force therethrough to the rod when received in the bore space.

In particular, the hook and thumb portions define a generally round cross sectional bore space to receive a correspondingly round cross sectional rod.

Releasable tightening means are provided on the wrist section to tighten it against the user's wrist to inhibit water seepage into the mitten cavity and reduce mitten stretching or shifting in use. The tightening means may include a wrist strap engageable with a local portion of the wrist section exterior, e.g. with the strap and wrist section local portion having coacting hook catch and pile releasable engaging means.

The sheeting material is preferably an elastomer material, such as elastomer foam, e.g. with an interior fabric lining, and especially neoprene rubber, such as neoprene foam rubber.

The sheeting material may include a back hand panel, a palm panel, a little finger side panel, a thumb side panel and a pair of thumb enclosure wall panels, structurally interconnected to form an integral unit comprising the wrist and hand enclosing sections. Desirably, the little finger side panel and thumb side panel are formed of sheeting material of sufficiently larger thickness than the remaining panels, e.g. about two times that of the remaining panels, to keep the back hand panel and palm panel in selectively spaced curved relation to each other to receive the first four fingers in unstrained curled condition and to preserve the permanently curved disposition of the hook portion relative to the thumb portion.

Advantageously, the palm panel has a reinforcing sheeting portion capable of enhancing frictional gripping of the rod.

BRIEF DESCRIPTION OF THE DRAWINGS

Other objects of the invention will become apparent from the within specification and accompanying drawings, in which:

FIG. 1 is a schematic perspective view of a precurled left hand mitten according an embodiment of the invention; and FIGS. 2, 3, 4 and 5 are respective palm, back hand, thumb and little finger, side elevational views of the FIG. 1 mitten, FIGS. 2, 4 and 5 showing the relationship of the curl-like bore space of the mitten and engaged force transmission rod.

DESCRIPTION OF THE PREFERRED EMBODIMENTS

Referring to the drawings, and initially to FIG. 1, a precurled mitten 1 is shown, for gripping a hand holdable force transmission rod or boom R (FIGS. 4–5), such as a 1¾ inch diameter round cross sectional metal sail boom as used in wind surfing. Mitten 1 has a rear or proximate wrist enclosing section 2 and front or distal hand enclosing section 3 integral with wrist section 2 to form a waterproof cavity 4. Hand section 3 terminates in a self-standing permanently curved hook portion 5 following the natural, relaxed contour of the user's curled hand to receive the first four fingers, and an opposed self-standing permanently curved thumb portion 6 following the natural, relaxed contour of the thumb to receive the thumb.

Hook and thumb portions 5 and 6 define therebetween a self-standing laterally extending concave curl-like, e.g. round cross sectional, bore space 7 sized and shaped to receive and normally snugly releasably embrace, e.g. round cross sectional, boom R (FIGS. 4–5), independently of finger gripping force, and to aid positive gripping of boom R under unrestrained and thereby reduced finger gripping force through mitten 1.

Releasable tightening means, formed of a wrist strap 8 engageable with a local exterior surface portion 9 of wrist section 2 are provided to tighten wrist section 2 on the user's wrist to inhibit water seepage into cavity 4 and reduce stretching or shifting of mitten 1 in use. Strap 8 and local portion 9 have coacting hook catch 10*a* and pile 10*b* releasable engaging means, e.g. as sold under the trademark VELCRO. Of course, other appropriate tightening means may be used instead.

Wrist and hand sections 2 and 3 are formed of waterproof, thermally insulating, shape retaining, pliable sheeting material 11 that can transmit, substantially undiminished, hand exerted gripping force therethrough to boom R in bore space 7 (FIGS. 2, 4 and 5). Material 11 may be an elastomer, such as an elastomer foam, material, e.g. neoprene, such as neoprene foam, rubber, which is a waterproof, thermally insulating, shape retaining, pliable material of robust and durable structural integrity, used to make diver and wind surfer wet suits, or may be any other suitable material of like characteristics. Material 11 desirably has an interior fabric lining 12.

Material 11 may be conveniently stitched at adjacent edges of the portions thereof arranged to form mitten 1, as shown schematically by stitching 13 in FIGS. 1–2, and then glued along its stitched seams by conventional cement to seal the seams hermetically and bond the adjacent edges into a selfstanding integral waterproof hand closure embodying mitten 1.

In one form, mitten 1 be a hollow rectangular structure, e.g. formed of stitched and cemented conforming flat blanks or panels, sized for insertion of the user's open hand and for close, yet unstrained, recept ɔn of the natural, relaxed contour curled hand in section ·and of the wrist in section 2. Mitten 1 may have a back nand panel 14, a palm panel 15, a little finger side panel 16, a thumb side panel 17 and a pair of thumb enclosure wall panels 18 and 19, structurally connected as an integral unit forming wrist and hand sections 2 and 3.

Little finger side panel 16 and thumb side panel 17 are preferably formed of material 11 of sufficiently larger thickness than, e.g. twice that of, the remaining panels, such as ¼ inch thick panels 16 and 17 as compared to ⅛ inch thick panels 14, 15, 18 and 19, to keep back hand panel 14 and palm panel 15 in selectively spaced curved relation to each other to receive the first four fingers in unrestrained curled condition and to preserve the permanently curved self-standing disposition of hook portion 5 relative to thumb portion 6.

Desirably, palm panel 15 has a reinforcing frictional sheeting portion or overlay panel 20, to increase friction, and which greatly enhances the ability of mitten 1 to grip boom R in bore space 7 between palm panel 15 and thumb wall panels 18 and 19 (as shown in phantom in FIG. 2, and in full line in FIGS. 4–5), and also makes mitten 1 significantly more durable.

Of course, mitten 1 may be formed in any other suitable manner and have a different hollow cross sectional shape, e.g. a more rounded corner or oval shape, such as by molding technique to provide an integral hand closure of desired type.

A distinct attribute of the increased thickness construction of little finger side panel 16 and thumb side panel 17 is that they maintain back hand panel 14 and palm panel 15 in the desired spaced relation and impart a stable permanent curve shape to hook portion 5, in conjunction with the facing apposition construction of thumb wall panels 18 and 19 and their seating at their base margins to the adjacent margins of thumb side panel 17 and palm panel 15 (FIG. 2) for similar stable permanent shaping of these self-standing portions of mitten 1.

The specific feature of the permanent curve shape of mitten 1 distinguishes the invention construction from a conventional glove. With this permanent curve feature, the user's hand does not have to strain against mitten 1 to grip boom R properly, as would continuously be needed to overcome the natural resistance against bending of a flat or straight shape five fingered glove in order to curl the same, since precurled hook portion 5 follows the natural, relaxed contour of the curled hand, and it is in this precurled condition that the continuous unrestrained gripping of boom R takes place in wind surfing with mittens 1. The net result is that the user's hands and forearms do not strain or fatigue with mittens 1.

At the same time, this permanent curve feature is combined with a mitten construction as hand closure, which encloses the first four fingers together in a common cavity, thereby keeping these side by side fingers, and in turn the rest of the hand, warmer than in a glove having five individual finger cavities, as the mitten common cavity reduces the sheeting material surface area exposed to the elements and minimizes heat exchange thermal loss therethrough. As the purpose of mitten 1 is to grip boom R by the fingers in unison for prolonged periods, there is no vital need for individual finger movement.

In contrast thereto, the usual glove has a significantly larger exposed sheeting material surface area, represented by the intervening sides of the individual finger cavities, causing increased heat loss thereat, e.g. in cold water and/or weather use of the glove, while individual finger movement in the glove is of no vital advantage in wind surfing or the like.

Using a thick wall glove to offset the increased heat loss through the greater exposed surface area of the individual finger cavities of the glove, causes the user's forearm and hand to strain and fatigue very quickly due to the extra effort needed to grip boom R firmly through the inherently curlresisting thick wall material, whereas if the glove has a gripaiding thin wall, it fails to keep the user's hand warm.

This invention solves both problems by combining both warmth and the ability to transmit, substantially undiminished, hand force through mitten 1 to grip boom R easily and firmly for prolonged wind surfing without strain, since precurled mitten 1 self-embraces boom R independently of the need for applying finger gripping force, i.e. to curl it around boom R, yet permits rapid and safe release of mitten 1 from boom R in an emergency by uncurling the hand to open bore space 7 between unconnected hook portion 5 and thumb portion 6 due to the inherently resilient pliable nature of sheeting material 11.

Mitten 1 constitutes a heat conserving construction which may be fabricated simply and inexpensively from conventional materials, and which is robust and durable in use. The resiliency of pliable sheeting material 11, and sizing and shaping of the parts forming mitten 1, e.g. panels 14–20, efficiently provide a desired construction for unstrained and durable use, with quick and safe separation of mitten 1 via unconnected hook portion 5 and thumb portion 6 from boom R in an emergency, even by a fatigued hand and forearm of the user.

The specification and drawings are set forth by way of illustration and not limitation, and various modifications and changes may be made therein without departing from the spirit and scope of the invention which is to be limited solely by the scope of the claims.

What is claimed is:

1. A precurled mitten for gripping a hand-holdable force transmission rod, such as a sail boom as used in wind surfing, comprising:

a rear wrist enclosing section and a front hand enclosing section integral therewith to form a mitten cavity, having an entrance thereto:

said hand enclosing section terminating in a generally permanently curved hook portion following the natural, relaxed contour of a curled hand of a user, to receive the first four fingers of the hand, and having an opposed thumb portion, following the natural, relaxed contour of the corresponding thumb, to receive the thumb;

the hook and thumb portions defining therebetween an external bore space sized and shaped to receive therein such a force transmission rod;

said wrist and hand enclosing sections being formed of material capable of transmitting an exerted gripping force therethrough, the thumb portion being movable relative to the curved hook portion;

said hand enclosing section including a back hand panel, a palm panel, a little finger side panel and a thumb side panel, each panel being defined by respective edges, one end of each said panel respectively extending lengthwise away from the entrance of the mitten cavity toward said curved hook portion, the other ends of said back hand and palm panels being joined together to form an extremity of said hook portion, the remaining edges of said back hand and palm panels being separated, said side panels tapering at their respective other ends and bridging the separations between said back hand and palm panels, at least the curved hook portion of said hand enclosing section tapering toward said hook extremity.

2. A mitten as in claim 1, wherein said panels are dimensioned and joined together to form parallelogram cross sections for said glove from the entrance to said mitten to said curled extremity.

3. A mitten as in claim 1, wherein said mitten is generally waterproof and said panels are formed of sheet material.

4. Mitten of claim 3 wherein the sheeting material is structurally interconnected to form an integral unit comprising the wrist enclosing and hand enclosing sections.

5. Mitten of claim 4 wherein the little finger side panel and thumb side panel are formed of sheeting material of sufficiently larger thickness than the remaining panels to maintain the back hand panel and palm panel in selectively spaced curved relation to each other to receive the first four fingers in unstrained curled condition therein and to preserve the generally permanently curved disposition of the hook portion relative to the thumb portion.

6. Mitten of claim 5 wherein such larger thickness is about two times that of the remaining panels.

7. Mitten of claim 4 wherein the palm panel is provided with a reinforcing sheeting portion capable of enhancing frictional gripping of the rod thereat.

8. Mitten of claim 1 wherein the hook and thumb portions define a generally round cross sectional bore space to receive a correspondingly round cross sectional rod.

9. Mitten of claim 1 wherein releasable tightening means are provided on the wrist enclosing section to tighten the wrist enclosing section against the wrist of the user to inhibit seepage of water into the mitten cavity and to reduce stretching or shifting of the mitten in use.

10. Mitten of claim 9 wherein the tightening means include a wrist strap engageable with a local portion of the exterior of the wrist enclosing section.

11. Mitten of claim 10 wherein the strap and local portion of the wrist enclosing section are provided with coacting hook catch and pile releasable engaging means.

12. Mitten of claim 1 wherein the sheeting material is elastomer material.

13. Mitten of claim 12 wherein the sheeting material is elastomer foam material.

14. Mitten of claim 12 wherein the sheeting material has an interior fabric lining.

15. Mitten of claim 12 wherein the sheeting material is neoprene rubber.

16. Mitten of claim 15 wherein the sheeting material is neoprene foam rubber.

17. Mitten of claim 15 wherein the sheeting material has an interior fabric lining.

* * * * *